United States Patent [19]

Gwozdz

[11] 4,148,001

[45] Apr. 3, 1979

[54] ELECTRIC SWITCH-CONCEALING HINGE

[75] Inventor: Joseph W. Gwozdz, Clark Summit, Pa.

[73] Assignee: McKinney Manufacturing Company, Scranton, Pa.

[21] Appl. No.: 846,381

[22] Filed: Oct. 28, 1977

[51] Int. Cl.[2] ..... H01H 9/00

[52] U.S. Cl. ..... 335/205; 200/61.7

[58] Field of Search ..... 335/205, 207, 206; 200/61.7

[56] References Cited

U.S. PATENT DOCUMENTS

| | | | |
|---|---|---|---|
| 3,806,852 | 4/1974 | Suska | 335/205 |
| 3,896,404 | 7/1975 | Peterson | 335/205 |
| 4,072,917 | 2/1978 | Haag et al. | 335/205 |

*Primary Examiner*—George Harris

*Attorney, Agent, or Firm*—Brown, Flick & Peckham

[57] ABSTRACT

A hinge is secured to the jamb of a door frame and to the adjacent edge of a door in the frame. Behind the hinge leaves the jamb and the door are provided with aligned holes that are concealed by the hinge. The back of each hinge leaf is provided with a recess facing the adjacent hole. A magnetically operated electric switch is held in the jamb hole and projects into the jamb leaf recess, and a magnetic device is held in the door hole and projects into the door leaf recess. The switch and magnetic device are not attached to the hinge.

7 Claims, 5 Drawing Figures

ELECTRIC SWITCH-CONCEALING HINGE

Door hinges installed in buildings are sometimes provided with electric switches that control electric circuits operating lights or audible signals so that an observer or monitor remote from the doors can tell whether or not the doors are closed or whether they have been opened by unauthorized persons. In many cases the presence of the switches is revealed whenever the doors are open, making it possible for a would-be intruder to deactivate the monitoring system in some way before attempting an entrance. Furthermore, some switches that are rigidly mounted on hinges project a considerable distance into holes in the jambs to which the hinges are secured, as shown in U.S. Pat. No. 3,806,852. When the switches are magnetically operated, the operating magnets likewise project from the hinges into holes in the doors. In such cases, when a workman unscrews a hinge from a door frame, if he does not realize that a switch extends into the jamb he may try to swing the hinge leaf away from the jamb. This often results in breaking off the switch, which should be removed from the jamb only by pulling it straight out of the hole in which it is disposed.

It is an object of this invention to provide magnetically activated switches and their operating magnets which are completely concealed by the door hinges but which are not attached to the hinges. Another object is to provide a hinge formed to allow a switch and magnet to be located closer together than the combined thickness of the hinge leaves when the door is closed.

The invention is illustrated in the accompanying drawings, in which

Figure 1:
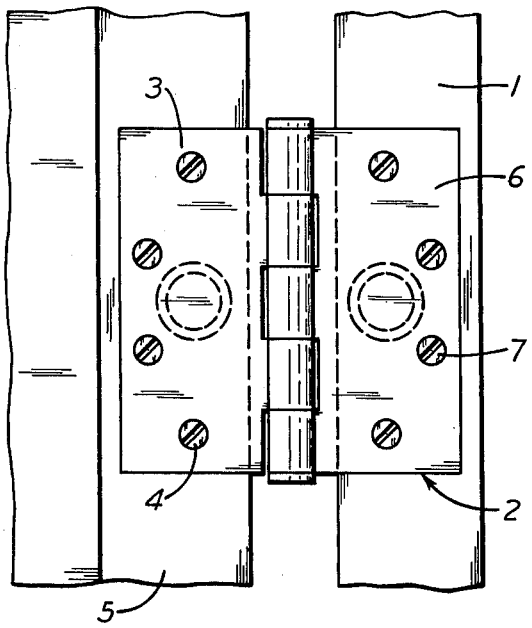
FIG. 1 is a view of the exposed or front side of an open hinge attached to a wooden door and jamb.
Figure 2:
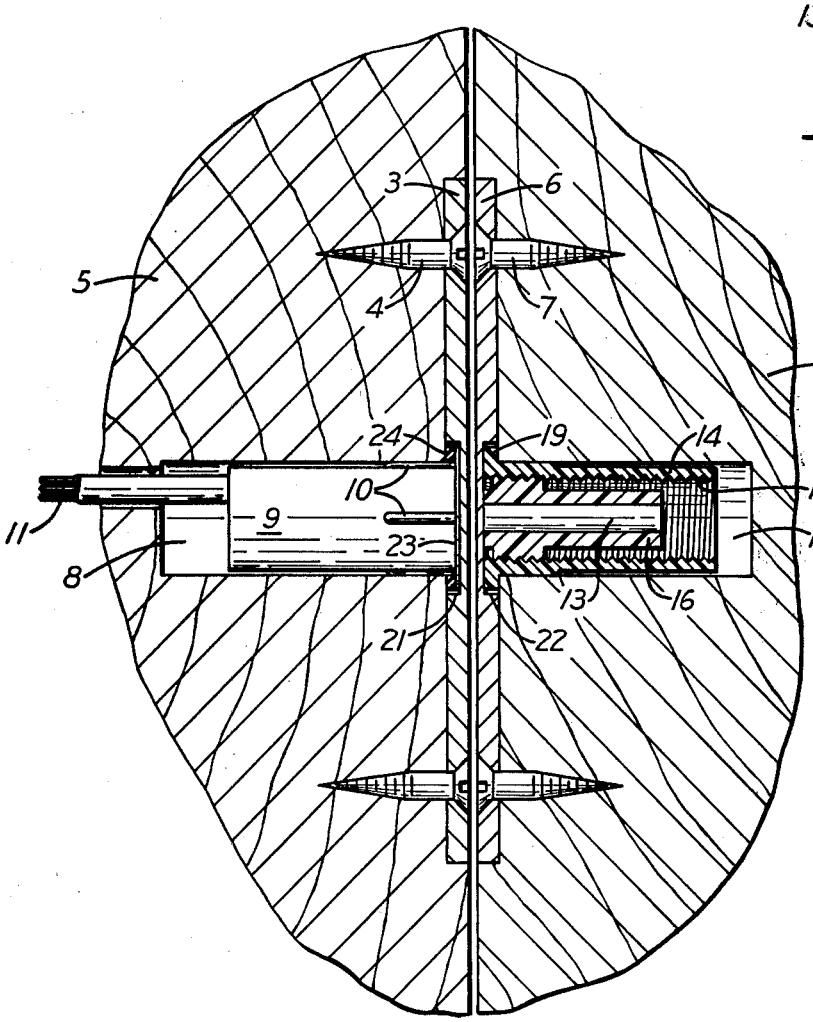
FIG. 2 is an enlarged vertical section of the closed hinge, with the magnetic device also shown in section.

Referring to FIGS. 1 and 2 of the drawings, a door 1 is shown supported in part by a hinge 2, usually the middle one of three vertically spaced hinges. This hinge has a jamb leaf 3 connected by screws 4 to the jamb 5 of a door frame, and a door leaf 6 connected by screws 7 to the adjacent edge of the door. Behind the central part of the jamb leaf the jamb is provided with a hole 8, in which a magnetically operated electric switch 9 is rigidly mounted. This switch may be a reed switch of known construction, in which the switching elements are housed in a cylindrical plastic or non-ferrous metal housing provided at the outer end portion with circumferentially spaced longitudinal ribs 10 that press into the wood of the door frame. The usual wires 11 are led out of the inner end of the switch housing and are connected with a signal light or other monitoring element (not shown). If a signal light is used, the switch can be normally open or normally closed, but if an audible alarm is used the switch should be normally closed. In either case, the switch is operated when a magnet is brought close to its outer end.

Figure 3:
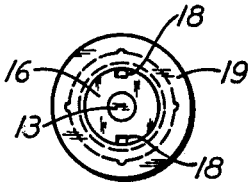
FIG. 3 is a view of the front end of the magnetic device.

The magnet 13 is disposed in a plastic or non-ferrous metal housing 14 similar to the switch housing and it is rigidly mounted in a hole 15 in the door. The magnet is mounted in a plastic or non-ferrous metal cylinder 16 provided with external screw threads engaging internal threads 17 in the housing so that the magnet can be adjusted lengthwise of the housing by inserting a suitable tool in notches 18 (FIG. 3) in the outer end of the cylinder to turn it. A flange 19 encircling the outer end of the housing limits the distance that the magnetic device can be inserted in the door. The thickness of this flange is less than the thickness of the adjoining door leaf.

It is a feature of this invention that the outer ends of the switch and magnetic device or member can be located as close together as possible when the door is closed, thereby improving the operation of the switch but without revealing their presence. Accordingly, the back of the jamb leaf of the hinge is provided with a recess 21 facing the jamb and axially aligned with the hole 8 in the jamb. This recess extends most, but not all, of the way through the hinge leaf. If the hinge is brass or some other non-ferrous metal, the recess is produced by simply boring a hole of the desired depth in the hinge leaf. On the other hand, if the hinge is made of steel the recess is formed in the manner that will be described in connection with FIG. 5. The door leaf of the hinge likewise is provided with a recess 22 facing the hole 15 in the door that contains the magnetic device. The flange 19 at the outer end of this device extends into the recess as far as its front end wall. If a flange happens to be thinner than the depth of the hinge recess that receives it, as shown by flange 23 around the outer or front end of the switch member, the flange is held against the front wall of the recess by a spacer 24, such as an O-ring encircling the switch behind the flange.

The result of this construction is that the outer ends of the switch member and the magnetic member are separated a distance that is considerably less than what it would be if the hinge leaves were not provided with the recesses. Consequently, the influence of the magnet on the switch is improved. Another advantage is that the switch and magnet are independent of and free of the hinge. They are installed before the hinge, and the hinge can be removed without disturbing them, thereby avoiding the possibility of damaging them. While the hinge is in place, the switch and magnet are completely concealed from view.

Figure 4:
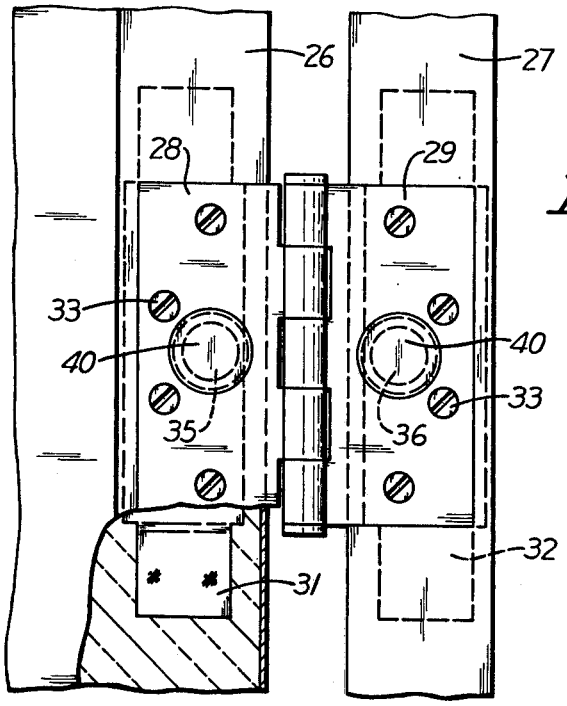
FIG. 4 is a view, similar to FIG. 1, of a hinge attached to a metal door and jamb.
Figure 5:
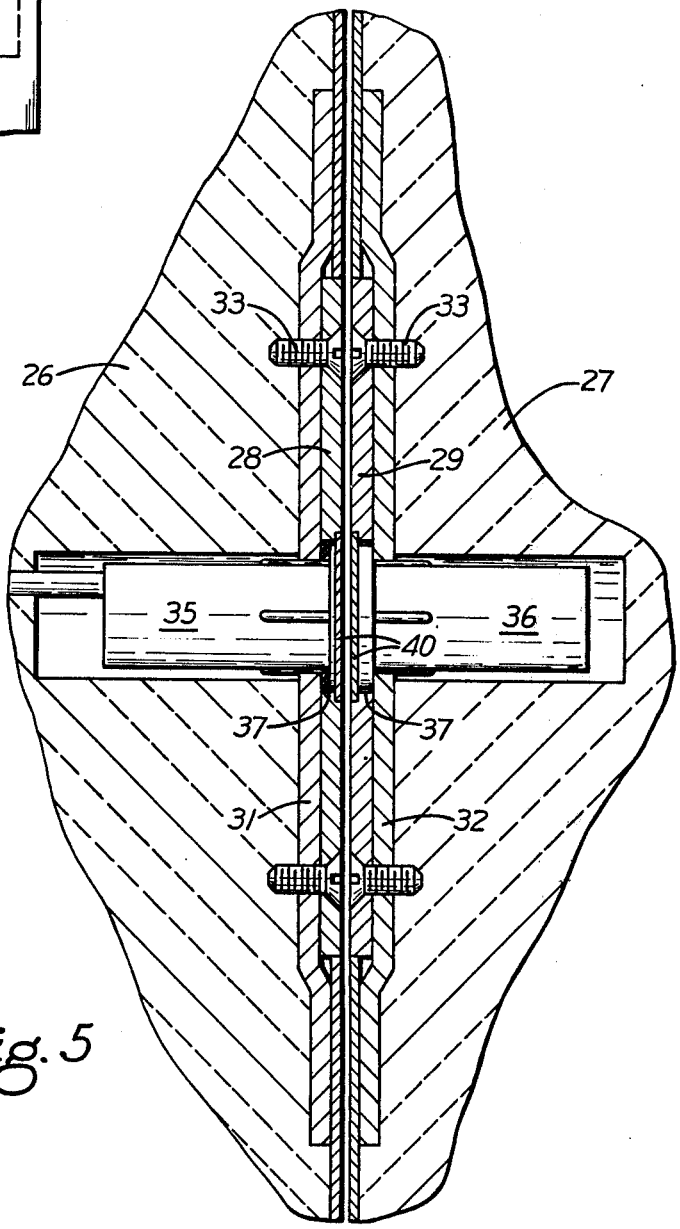
FIG. 5 is a vertical section through that hinge closed.

In case the hinge is to be used with a metal door frame and metal door as shown in FIGS. 4 and 5, the sheet metal forming the jamb 26 and the door 27 is provided with openings for receiving the hinge leaves 28 and 29 so that the outer faces of the leaves will be substantially flush with the outer surfaces of the jamb and door. Before the hinge is put in place, however, narrower metal plates 31 and 32 are welded to the inner surfaces of the sheet metal above and below the openings for the hinge. The central portions of these plates are offset away from each other to accommodate the closed hinge between them. The plates are provided with threaded holes aligned with the holes in the hinge leaves, and screws 33 are inserted to attach the leaves to the plates.

Again, before the hinge is put in place, an electric switch member 35 is inserted in a hole through the jamb plate 31 about midway between its upper and lower ends. A magnetic device 36 is inserted in a hole in the other plate, the second hole being axially aligned with the first hole. The switch and magnetic device are rigidly mounted in these plates and extend into openings in the insulation or other material with which the door and door frame may be filled. The outer ends of the switch and magnetic members extend a short distance toward each other. These projecting outer ends extend into recesses 37 in the back of the hinge leaves, like those described before.

FIG. 5 also illustrates what is done in case the hinge is steel, which could interfere with the operation of the switch by the magnet. In the case of a steel hinge, recesses 37 are formed by just drilling holes entirely through the hinge leaves and then closing their outer or front ends with disks 40 of non-ferrous metal. These disks are attached to the hinge in any suitable manner, such as by counterboring the outer ends of the drilled holes and then setting the disks into the leaves and brazing them in place to form the front walls of the recesses. The outer faces of the disks should be flush with the surrounding surfaces of the hinge leaves. After polishing and plating, the disks are not visible.

It will be seen that when the hinge is removed from mounting plates 31 and 32 there is no danger of breaking the switch or the magnetic device because they are not attached to the hinge, but remain with the plates. If either the switch or the magnet has to be removed, it is clear to the workman that it must be pulled straight out of the mounting plate.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In combination with a door frame having a jamb and containing a normally closed door, a hinge with jamb and door leaves disposed between said jamb and adjacent edge of the door and secured thereto, the jamb having a hole extending into it from behind the jamb leaf of the hinge, the door having a hole extending into it from behind the door leaf of the hinge and aligned with the jamb hole while the door is closed, said hinge leaves concealing said holes from view, the back of said jamb leaf being provided with a recess facing the jamb hole, the back of the door leaf being provided with a recess facing the door hole, said recesses having front walls facing each other, a magnetically operated electric switch member frictionally held in said jamb hole and projecting into said jamb leaf recess, and a magnetic member frictionally held in said door hole and projecting into said door leaf recess, said switch and magnetic members being unattached to said hinge so that the hinge can be removed intact without disturbing them.

2. In the combination recited in claim 1, said hinge leaves being steel, and each of said recesses being formed by an opening extending through the corresponding hinge leaf and by a non-ferrous disk forming the front wall of the recess and countersunk in said opening substantially flush with the surrounding surface of the leaf.

3. In the combination recited in claim 1, the exposed end of at least one of said members being surrounded by a flange having a thickness less than the depth of the recess receiving it, and a spacer surrounding the flanged member behind the flange and holding the flanged member against the front wall of the recess.

4. In the combination recited in claim 1, a metal plate secured to said jamb and provided with an opening aligned with said jamb hole, said switch member extending through said opening and rigidly mounted therein, a metal plate secured to said edge of the door and provided with an opening aligned with said door hole, said magnetic member extending through said last-mentioned opening and rigidly mounted therein, said plates and hinge leaves being provided with registering screw-receiving holes, and screws extending through said registering holes fastening the hinge to said plates.

5. In the combination recited in claim 4, said switch and magnetic members being provided with external ribs extending through said plate openings and pressing against the walls thereof to hold the switch and magnetic members in place.

6. In the combination recited in claim 1, said jamb and door being wood, said switch and magnetic members being provided with external ribs extending lengthwise of said holes, and said ribs pressing against the surrounding walls of said holes to hold the switch and magnetic members in place.

7. In the combination recited in claim 1, said magnetic member including a magnet that is adjustable lengthwise of said door hole.

* * * * *